United States Patent [19]

Krings

[11] Patent Number: 4,843,780

[45] Date of Patent: Jul. 4, 1989

[54] CONSTRUCTION PLATE

[76] Inventor: Josef Krings, Brahmsstr. 1, D-5138 Heinsberg, Fed. Rep. of Germany

[21] Appl. No.: 257,745

[22] Filed: Oct. 13, 1988

Related U.S. Application Data

[63] Continuation-in-part of Ser. No. 914,474, Oct. 2, 1988.

[30] Foreign Application Priority Data

Oct. 2, 1985 [DE] Fed. Rep. of Germany ..... 3535201

[51] Int. Cl.[4] ..... E04C 2/32

[52] U.S. Cl. ..... 52/795; 52/814

[58] Field of Search ..... 56/795, 796, 797, 798, 56/220, 806, 807, 808, 814, 801; 296/182; 105/422

[56] References Cited

U.S. PATENT DOCUMENTS 2,228,650 1/1941 Young et al. ..... 52/797 X 3,959,943 6/1976 Shea et al. ..... 52/795

4,048,778 9/1977 Krings ..... 52/309.11 X

FOREIGN PATENT DOCUMENTS 125185 4/1919 United Kingdom ..... 52/796

*Primary Examiner*—Carl D. Friedman

*Attorney, Agent, or Firm*—Collard, Roe & Galgano

[57] ABSTRACT

A construction plate is provided consisting of two outer plates folded to form webs extending laterally therefrom so that the webs form spacers between the outer plates, and with end supports terminating the face sides of the outer plates arranged perpendicular to the ducts of the folds. Each outer plate has a corrugation having an M-shaped cross section adapted to hold the front edge of a web of an opposing outer plate, the corrugation being displaced with respect to the webs by half a division and extending parallel to the webs.

8 Claims, 3 Drawing Sheets

CONSTRUCTION PLATE

This is a continuation-in-part of my ealier filed application, U.S. Ser. No. 914,474, filed Oct. 2, 1986 now abandoned, entitled "Construction Plate".

The present invention relates generally to a construction plate consisting of two outer plates that are interconnected by webs each having a front edge and extending laterally from each plate to the other in the form of spacers and displaced or staggered with respect to each other to define equidistant spaces therebetween. The webs are formed by folding the outer plate perpendicular to its plane, then folding the web on itself and then back into the plane of the outer plate, the opposing outer plates and lateral webs forming a profile with rectangular channels on one side and a non-channelled outer surface. End supports, arranged perpendicular to the ducts formed by the folds, terminate the face sides of the outer plates.

Construction plates with the above features are known from my earlier U.S. Pat. No. 4,048,778, granted Sept. 20, 1977, and are intended for cribbing trenches. With such construction plates, the front edge of the web formed by the fold is joined with the associated, opposite outer plate by a lengthwise extending welded joint. This type of construction is relatively expensive in terms of welding, which is very costly in labor requirements and which is also time-consuming. In addition, a construction plate formed according to this prior art method is subjected to high thermal stresses due to the large number of welded joints.

In view of the above, it is the object of the present invention to provide a construction plate which requires significantly less welding and which can be manufactured in a relatively easy manner.

The above object is accomplished in accordance with the present invention by providing a construction plate formed of two outer plates folded so as to be interconnected by webs each having a front edge and extending laterally from each plate to the other in the form of spacers and displaced or staggered with respect to each other to define equidistant spaces therebetween, the webs being formed by folding the outer plate perpendicular to its plane, then folding the web on itself and then back into the plane of the outer plate, the opposing outer plates and lateral webs forming a profile with rectangular channels or ducts on one side and a non-channelled outer surface and with end supports terminating the face sides of the outer plates arranged perpendicular to the ducts formed by the folds. Each outer plate has at least one corrugation of M-shaped cross-section adapted to receive the front edge of a web of an oppositely disposed outer plate, the corrugation being displaced with respect to the webs by half a division therebetween and extending parallel thereto. The construction plate according to the present invention requires only a fraction of the welded joints that were previously needed, particularly in connection with the joining of the front edges of the webs to the oppositely disposed outer plate, and the components of the plate are joined with each other in a substantially form-fitting manner. Combined with the end supports that are welded to the outer plates, this design results in a construction plate of excellent strength and stiffness.

The construction plate according to the invention may be made of steel, light gauge sheet metal or plastic material and used for different construction measures depending on its dimensions and the type of material used. Furthermore, it may have a filling, for example of a foam material or concrete, or armoring. In a manner known per se, it may be provided with installation conduits and serve, for example as a construction plate for buildings that must be erected quickly in disaster areas.

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

Figure 1:
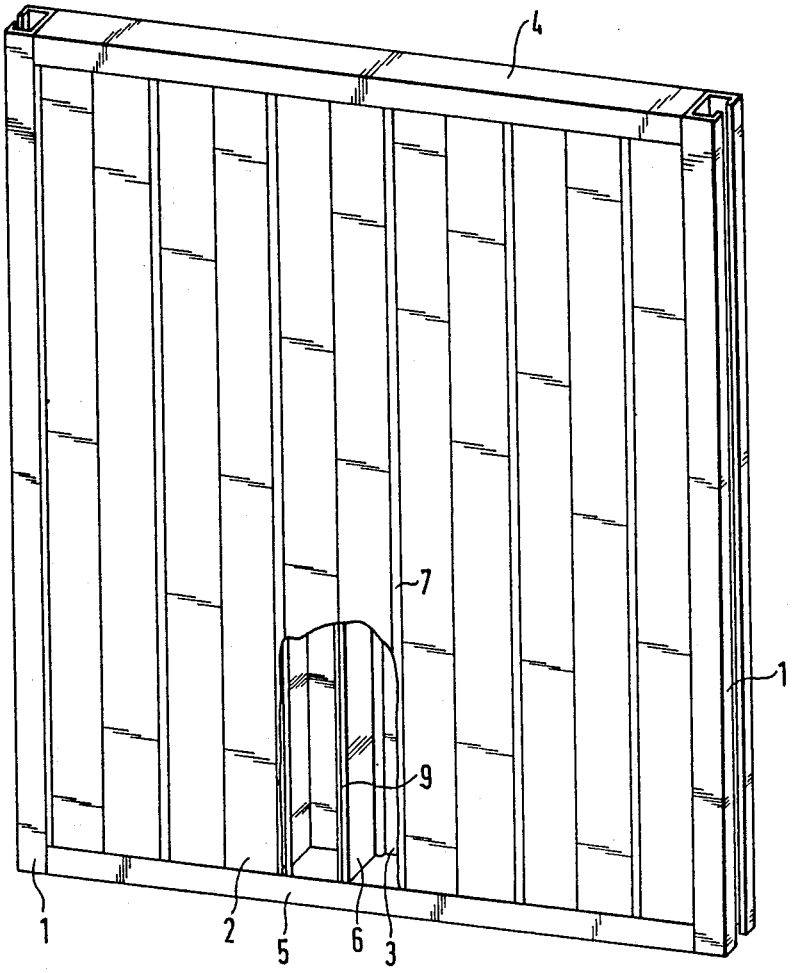
FIG. 1 is a perspective view of the construction plate according to the present invention, showing a portion thereof broken away.
Figure 2:
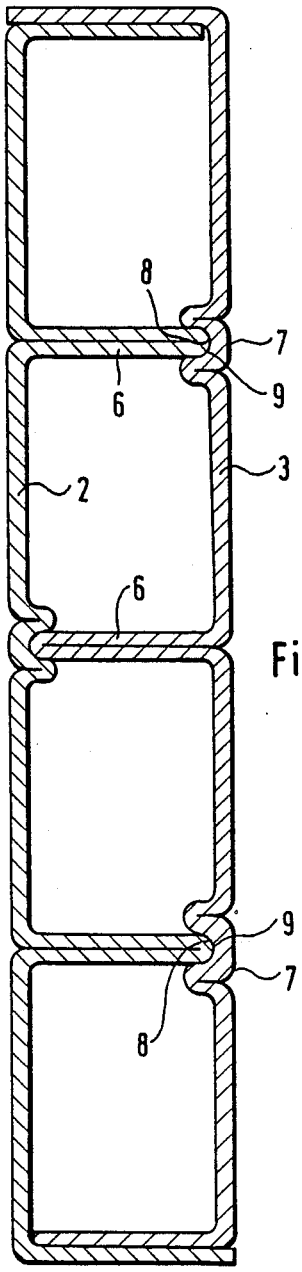
FIG. 2 is a schematic cross-sectional view of the construction plate according to the present invention.

Now turning to the drawings, there is shown in FIG. 1 the construction plate of the present invention consisting of vertical guide heads 1, for example in the form of C-profile supports, and outer plates 2 and 3, which are joined with such supports by welding, gluing or the like, with top and bottom end supports 4 and 5 welded to the outer plates.

The outer plates consist of thin, plate-like material, for example sheet steel or light gauge sheet metal, which is folded in such a way that webs 6 are formed with a regular division. The height of webs 6 is equal to the thickness of the construction plate to be built. The ducts formed by the webs of the folds are terminated by end supports 4 and 5. The respective outer plates are arranged opposite each other and displaced with respect to each other by half the division of the webs, which, because of the folding, have twice the wall thickness of outer plates 2 and 3.

A corrugation 7 having an M-shaped cross section is arranged in the outer plates centrally between each two adjacent webs 6 and extends parallel therewith. A median deepening 8 of corrugation 7 is designed to receive front edge 9 of a web 6 of an oppositely disposed outer plate 2 or 3. In each case, webs 6 and corrugations 7 are displaced with respect to each other by half a division.

The folding of outer plates 2 and 3, the form-fitting interlock between webs 6 and corrugations 7, as well as the way in which outer plates 2 and 3 are joined with end supports 4 and 5 by welding or gluing permit a minimum amount of welding and the manufacture of a strong construction plate. In particular, only spot or tack welds are required to join the front edge of a web to the M-shaped corrugation which receives it as opposed to a continuous weld required by such a construction plate without M-shaped corrugations.

In a manner known per se, webs 6 may have recesses designed to receive reinforcement tubes or struts. Furthermore, provision may be made for armoring between outer plates 2 and 3, and/or, for example, a foam filler, or conduits installed between such plates, if need be. The ducts formed by the folds may be arranged with a vertical or horizontal configuration.

Guide heads 1, by means of which the construction plate may be guided on a support or adjacent plate, may be omitted, or other connecting means may be used instead.

Figure 3:
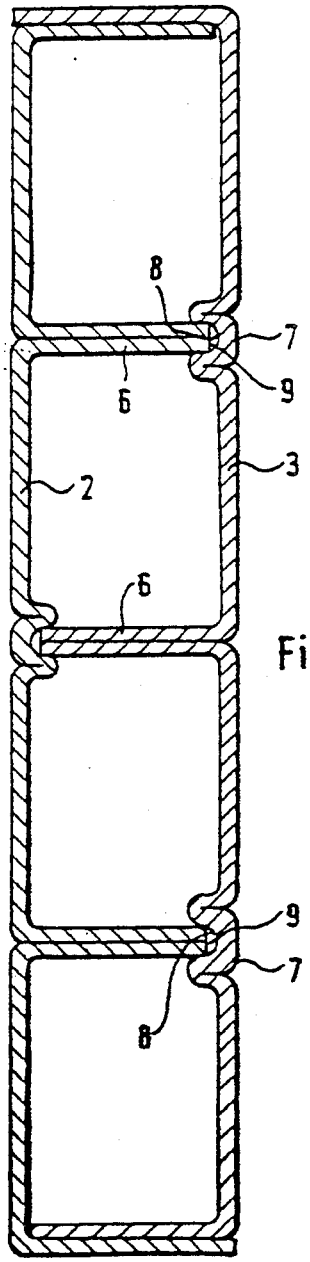
FIG. 3 is a schematic cross-sectional view similar to FIG. 2 of another embodiment of the present invention.

Instead of having the double-walled webs formed by the folds, the plate may have single webs, which are not connected with each other or joined with each other, as clearly seen in FIG. 3, and which engage corrugation 7 of the opposite outer plate. Thus, the webs 6 of adjacent plates are positioned to adjoin each other so that their combined front edges are engaged in the corresponding corrugation 7 of the opposing plate.

While only a single embodiment of the present invention has been shown and described, it will be obvious that many changes and modifications may be made thereunto without departing from the spirit and scope of the invention.

What is claimed is:

1. In a construction plate formed of two opposing, spaced apart outer plates separated by webs each having a front edge and extending laterally from each plate to the other in the form of spacers, the webs of the opposing plates being displaced or staggered with respect to each other so as to define equidistant spaces therebetween, said webs being double the thickness of one of said outer plates and formed by folding the outer plate perpendicular to its plane, then folding the web on itself and then back into the plane of the outer plate, the opposing outer plates and lateral webs forming a profile with rectangular channels on one side and a non-channelled outer surface of the plates, and end supports terminating the face sides of the outer plates arranged perpendicular to the rectangular channels, the improvement comprising:

corrugations having an M-shaped cross-section formed in each outer plate displaced equidistantly relative to adjacnt webs and extending parallel to the webs, each of said corrugations being aligned with and adapted to receive the front edge of an associated web of the opposing outer plate in a form fitting interlock.

2. The construction plate according to claim 1, wherein said outer plates consist of steel.

3. The construction plate according to claim 1, wherein said outer plates consist of light gauge sheet metal.

4. The construction plate according to claim 1, wherein said outer plates consist of plastic material.

5. The construction plate according to claim 1, wherein armoring is provided between the outer plates.

6. The construction plate according to claim 1, wherein a filler is provided between the outer plates.

7. The construction plate according to claim 1, wherein each outer plate is assembled from components which are rigidly joined with each other.

8. The construction plate according to claim 1, wherein said M-shaped corrugations define grooves which are adapted to receive the edges of two end webs of two succeeding plates.

* * * * *